US010173243B2

(12) United States Patent
Granato et al.

(10) Patent No.: US 10,173,243 B2
(45) **Date of Patent: *Jan. 8, 2019**

(54) TRANSDUCER DRIVER ATTENUATING INPUT CURRENT FREQUENCY AT MAXIMUM MECHANICAL OUTPUT

(71) Applicant: TEXAS INSTRUMENTS INCORPORATED, Dallas, TX (US)

(72) Inventors: Maurizio Granato, Milan (IT); Giovanni Frattini, Travaco Siccomario (IT); Roberto Massolini, Pavia (IT)

(73) Assignee: Texas Instruments Incorporated, Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/089,752

(22) Filed: Apr. 4, 2016

(65) Prior Publication Data

US 2016/0214140 A1 Jul. 28, 2016

Related U.S. Application Data

(63) Continuation of application No. 14/204,280, filed on Mar. 11, 2014, now Pat. No. 9,338,533.

(51) Int. Cl.

| | |
|---|---|
| ***B06B 1/02*** | (2006.01) |
| ***H04R 1/00*** | (2006.01) |
| ***H04R 3/06*** | (2006.01) |

(52) U.S. Cl.

CPC ..... *B06B 1/0284* (2013.01); *B06B 1/0292* (2013.01); *H04R 1/00* (2013.01); *H04R 3/06* (2013.01); *H04R 2217/03* (2013.01)

(58) Field of Classification Search

CPC ..... A44B 11/12; B05B 1/3013; B21D 53/085; E02F 5/027; G01S 15/04; G01S 15/88; G01S 15/8904; G01S 15/8993; G01S 7/521; G06F 3/0416; G06F 3/044; G11B 5/59605; H03G 9/025; H03G 9/005; H04R 1/00; H04R 2217/03; H04R 2499/13;

(Continued)

(56) References Cited

U.S. PATENT DOCUMENTS 5,022,083 A * 6/1991 Rimkeit ..... H03G 5/025 333/28 R
5,404,115 A * 4/1995 Johnson ..... H03G 9/18 330/133

(Continued)

FOREIGN PATENT DOCUMENTS

EP 1239603 A1 * 9/2002 ..... H03G 3/3047

*Primary Examiner* — Matthew Eason
*Assistant Examiner* — Julie X Dang
(74) *Attorney, Agent, or Firm* — Lawrence J. Bassuk; Charles A. Brill; Frank D. Cimino

(57) ABSTRACT

A transducer has an input and produces a mechanical output, wherein the magnitude of the mechanical output of the transducer is dependent on the frequency and magnitude of current at the input. A driver for the transducer includes a device having a transfer function associated with the device, the device having a device input and a device output, the device output being connectable to the input of the transducer and the device input being connectable to a power source. The device attenuates the current output at a frequency that causes a peak in the magnitude of the mechanical output of the transducer.

14 Claims, 3 Drawing Sheets

(58) Field of Classification Search
CPC ..... H04R 29/001; H04R 3/00; H04R 3/007; H04R 3/04; H04R 3/06; H04R 3/12; H04S 7/307
USPC ..... 381/162, 59, 55, 397, 316–118; 703/2
See application file for complete search history.

(56) References Cited

U.S. PATENT DOCUMENTS 6,329,886 B1 * 12/2001 Ogoro ..... H03H 7/38 333/32
8,432,170 B1 * 4/2013 Walsh ..... G06F 3/0416 324/658
8,542,840 B2 * 9/2013 Manninger ..... H04R 3/00 381/103
2003/0048569 A1 * 3/2003 Galloway ..... G11B 5/59605 360/78.04
2004/0176955 A1 * 9/2004 Farinelli, Jr. ..... H03F 1/52 704/255
2008/0062428 A1 * 3/2008 Millerd ..... G01B 9/02045 356/492
2008/0315948 A1 * 12/2008 Pyykonen ..... H03F 3/2173 330/251
2009/0009128 A1 * 1/2009 Okita ..... G05B 13/024 318/619
2009/0105858 A1 * 4/2009 Bonglovi ..... H04S 7/307 700/94
2009/0146752 A1 * 6/2009 O'Day ..... H03L 1/02 331/176
2009/0268918 A1 * 10/2009 Solgaard ..... H03G 9/005 381/55
2010/0278008 A1 * 11/2010 Ammar ..... G01S 7/521 367/7
2011/0238336 A1 * 9/2011 Di Scalea ..... G01N 29/043 702/56
2012/0287680 A1 * 11/2012 Luo ..... H02M 3/33507 363/21.02
2013/0266156 A1 * 10/2013 Frohlich ..... H03F 1/34 381/120
2015/0352713 A1 * 12/2015 Takazakura ..... B23B 37/00 173/2

* cited by examiner

TRANSDUCER DRIVER ATTENUATING INPUT CURRENT FREQUENCY AT MAXIMUM MECHANICAL OUTPUT

CROSS-REFERENCE TO RELATED APPLICATIONS

This continuation application claims priority to U.S. application Ser. No. 14/204,280, filed Mar. 11, 2014, now U.S. Pat. No. 9,338,533, issued May 10, 2016 which is incorporated herein by reference.

BACKGROUND

Air-coupled capacitive ultrasonic transducers generally have low bandwidths, meaning that a slight variation in the frequency of the power source driving a transducer has a large impact on the magnitude of the mechanical output. The low bandwidths are most prevalent on transducers that have high Q values in that a small change in the frequency of the power source results in a large change in the amplitude of the transducer mechanical output. This large change is greatest around the frequency of the power source that causes the greatest mechanical output. This frequency is sometimes referred to as the peak frequency.

The low bandwidth is present in micro-machined and piezoelectric transducers. The low bandwidth causes poor time domain performance because the transducers become under-dampened, which leads to a slow decay of the ringing after the transducers are excited by their power sources. In addition, the frequency domain performance suffers because the low bandwidth makes use of frequency modulated excitation, such as chirps, from the power sources, less effective. The use of coding is also limited because the low bandwidth requires the use of very long symbols in order to obtain frequency shaping. Therefore, frequency shaping is not attainable with the low bandwidths.

System feasibility is also reduced. The low bandwidths of the transducers adversely affect performance by causing mismatches between adjacent transducers. More specifically, a first transducer may have a peak frequency at f1 and a second transducer may have a peak frequency at f2 that is very close to the frequency f1. Because the bandwidths of the transducers are very narrow, the transducer operating at the frequency f1 may not be able to be matched to the transducer operating at the frequency f2.

SUMMARY

A transducer has an electrical input and produces a mechanical output, wherein the magnitude of the mechanical output of the transducer is dependent on the frequency and magnitude of current at the input. A driver for the transducer includes a device having a transfer function associated with the device, the device having a device input and a device output, the device output being connectable to the input of the transducer and the device input being connectable to a power source. The device attenuates the current output at a frequency that causes a peak in the magnitude of the mechanical output of the transducer.

DETAILED DESCRIPTION

Circuits and methods that increase the bandwidth of transducers, including air-coupled capacitive ultrasonic transducers, are described herein. Examples of these transducers include micro-machined devices, such as micro-electro-mechanical systems (MEMS), and piezoelectric transducers. Some MEMS devices are referred to as capacitive micro-machined ultrasonic transducers (CMUT). In summary, the circuits and methods described herein attenuate the magnitude of the power input to the transducer around the peak frequency of the transducer. The peak frequency of a transducer is the frequency at which the magnitude of the mechanical output is at a maximum. The resulting magnitude of the mechanical output is then substantially flat over a predetermined bandwidth. In the embodiments described herein, the mechanical output is an acoustic wave, such as the acoustic waves produced by ultrasonic transducers. The circuits and methods described herein may be applied to transducers that produce other mechanical outputs.

The above-described transducers typically have excessive sensitivity that can be reduced for additional bandwidth. The sensitivity of a transducer is the amount of change in the mechanical output as a result of a change in the frequency of a power source that drives or otherwise powers the transducer. A transducer with high sensitivity produces a high mechanical output amplitude given a specific electrical input or frequency of the power source. With regard to transducers that generate acoustical waves, a highly sensitive transducer produces a high acoustical output amplitude given a specific electrical input, such as a narrow bandwidth of the power source.

Figure 1A:
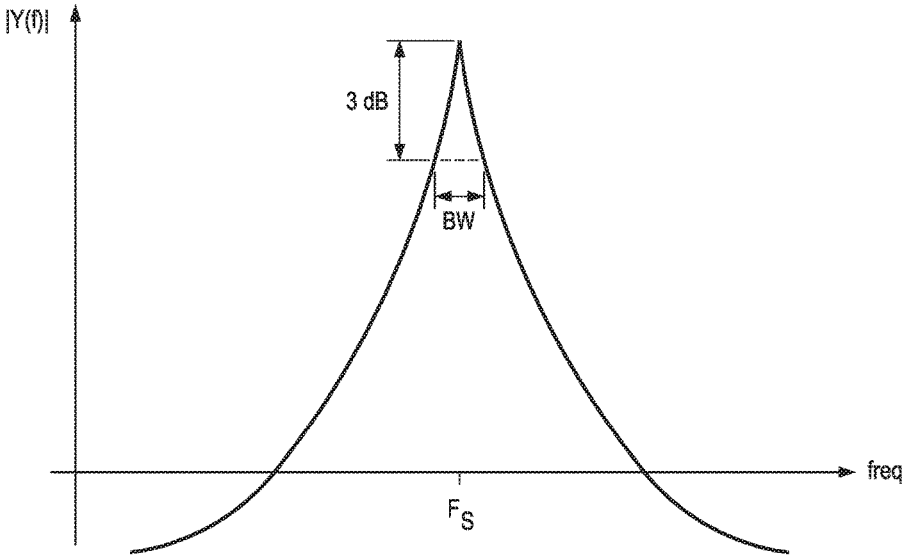
FIG. 1A is a graph showing the frequency response of a conventional transducer.
Figure 1B:
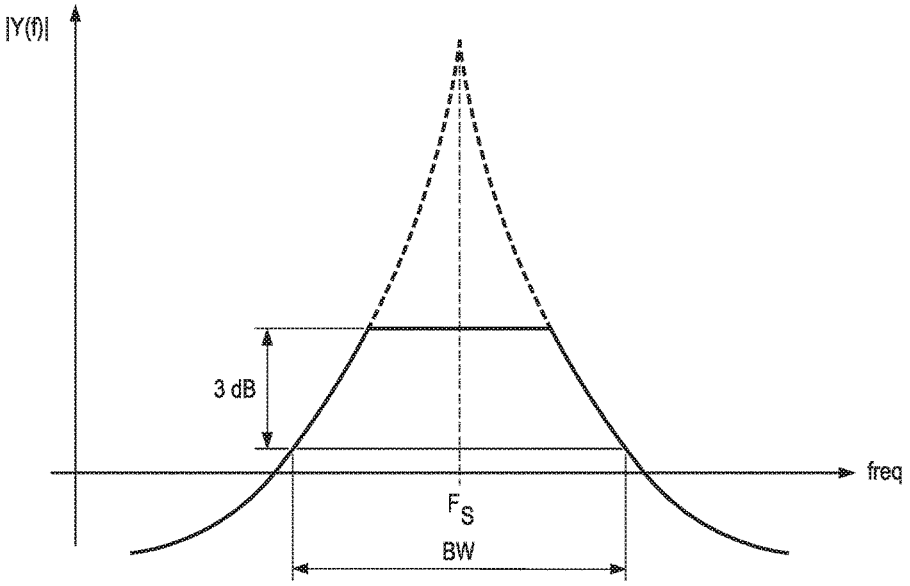
FIG. 1B is a graph showing the frequency response of the transducer of FIG. 1A where the sensitivity has been reduced in order to increase the bandwidth.

The tradeoff between sensitivity and bandwidth is summarily shown by the graphs of FIGS. 1A and 1B, which show the mechanical output Y(f) of conventional transducers and transducers driven by the circuits and methods described herein. FIG. 1A is a graph showing the magnitude of the mechanical output Y(f) of a transducer as a function of the frequency of its power source. The bandwidth (BW) is given around a frequency Fs and is defined by a 3 dB drop in the mechanical output Y(f). The frequency Fs is the frequency of the power source that results in the greatest magnitude of mechanical output Y(f) and is sometimes referred to as the peak frequency. In FIG. 1B, the sensitivity has been reduced by reducing the mechanical output Y(f) around the peak frequency. The mechanical output Y(f) is shown as being clipped by the graph of FIG. 1B, which reduces its sensitivity. The 3 dB bandwidth in FIG. 1B is much wider due to the reduced sensitivity. More specifically, the peak mechanical output has been reduced, which increases the bandwidth of the transducer. Therefore, by reducing the sensitivity or peak mechanical output of a transducer, the 3 dB bandwidth is significantly increased. In the embodiment of FIG. 1B, the amplitude of the mechanical output Y(f) is substantially flat in the 3 dB bandwidth. This flat bandwidth is sometimes referred to as a flatband response.

Figure 2:
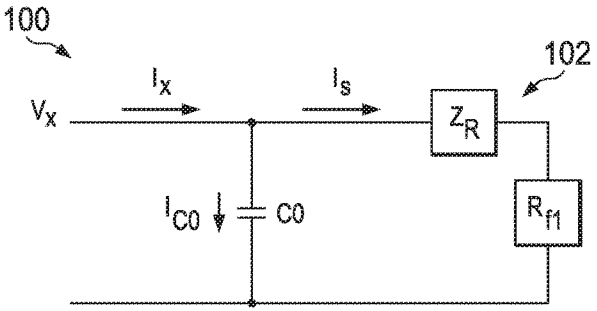
FIG. 2 is an equivalent circuit of an air-coupled capacitive ultrasonic transducer.

In order to achieve the mechanical output Y(f) of FIG. 1B, the transducer needs to be modeled. A transducer, such as the air-coupled capacitive ultrasonic transducer (referred to simply as the transducer) described above, is approximated by an equivalent circuit 100 as shown in FIG. 2. The circuit 100 is a representation of the acoustic domain of the transducer, which is described in greater detail further below. The circuit 100 includes a resonant branch 102 and a parallel capacitance C0. The capacitance C0 is sometimes referred to as the clamped capacitance at the bias voltage and is representative of the capacitance of the transducer. The capacitance C0 is derived from the intrinsic capacitance and the parasitic capacitance of the cavity of the transducer. The resonant branch 102 represents the resonant characteristics of the transducer. The voltage on the impedance $R_{f1}$ represents the sound pressure generated by the transducer, wherein the transducer in the example of FIG. 2 is an acoustic device. By controlling the current $I_S$ into the resonant branch 102, it is possible to control the mechanical output Y(f), or magnitude of the acoustic wave, generated by the transducer.

The current Is in the resonant branch 102 is controlled by a transfer function as described in greater detail below. In summary, the capacitance C0 and resonant branch 102 are modeled so that a controlling device can control the current Is. The current Is passing through the impedance $R_{f1}$ is proportional to the mechanical output Y(f). By measuring or calculating the current Ix entering the transducer, the amount of current Is flowing in the resonant branch 102 is determined based on the model of the transducer. As stated above, the current Is determines the magnitude of the acoustic wave generated by the transducer. A device controls the current Ix entering the transducer, which controls the current Is in the resonant branch 102, so the device controls the magnitude of the acoustic wave. The device operates by way of a transfer function that yields the mechanical output Y(f) as shown in FIG. 1B.

Having described the equivalent circuit 100, methods and circuits for increasing the bandwidths of transducers will now be described. Two methods and circuits are described herein, a closed loop system and an open loop system. The closed loop system will be described followed by a description of the open loop system. Both systems control the current Is in the resonant branch 102 with a large bandwidth, which in many embodiments is the maximum bandwidth of the resonant branch. This large bandwidth is reflected by the large bandwidth BW in FIG. 1B. Obtaining the maximum bandwidth involves identifying or otherwise determining the transfer function of the resonant branch 102 and applying a precondition to the power source or drive signal for the transducer. The precondition attenuates the drive signal at frequencies that cause the amplitude of the mechanical output Y(f) of the transducer to be the greatest. In FIG. 1B, these frequencies are centered around the frequency Fs.

Figure 3:
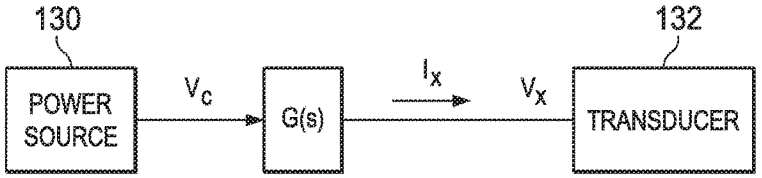
FIG. 3 is a block diagram summarizing the circuits and methods for increasing the bandwidth of a transducer.

The circuits and methods for driving a transducer 132 are summarily shown by the block diagram of FIG. 3. A power source 130 generates a voltage Vc. In conventional systems, the power source 130 is connected directly to the transducer 132. The power source 130, and therefore the voltage Vc, operates at a frequency or a bandwidth that is used to excite the transducer 132. The circuits and methods described herein use a transfer function, that is referred to as the closed loop transfer function G(s), to condition the voltage Vc before it excites the transducer 132. The transfer function G(s) generates a voltage Vx that is used to excite the transducer 132 to generate the mechanical output Y(f) as shown in FIG. 1B. In summary, the transfer function G(s) attenuates the components of the voltage Vc in the desired bandwidth of the transducer 132. The parameters of the transfer function G(s) are based on the equivalent electronic circuit of the transducer 132, such as the circuit 100 of FIG. 2. The transfer function G(s) is sometimes referred to as a device and may be implemented in a variety of different embodiments, such as hardware and software. In some embodiments, the transfer function G(s) is implemented as an active filter.

Figure 4:
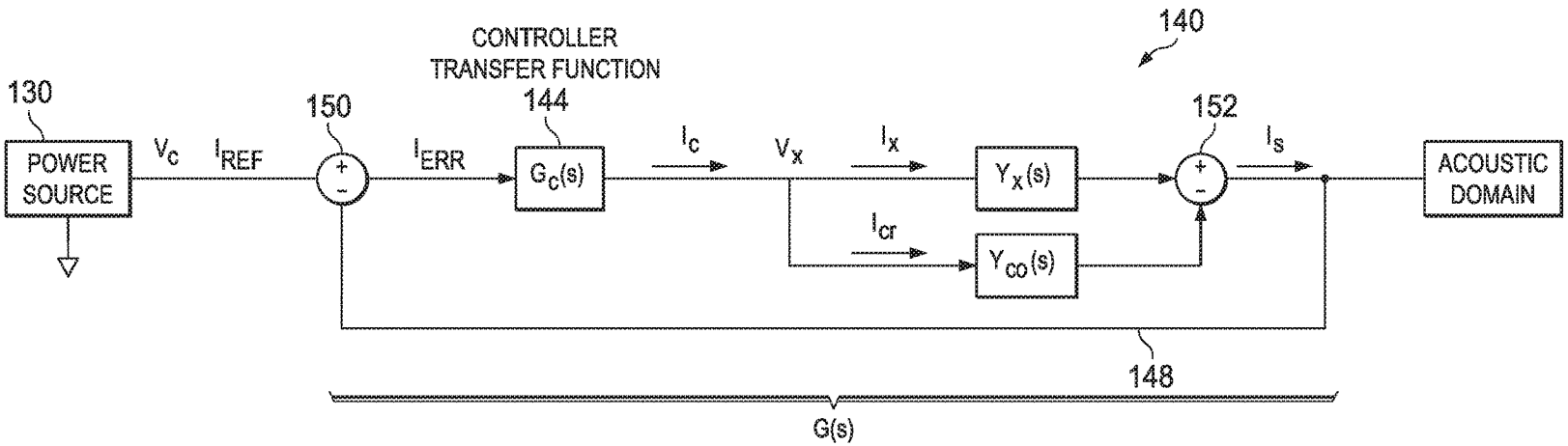
FIG. 4 is a block diagram of a closed loop embodiment of a system for increasing the bandwidth of the transducer.

A block diagram of an embodiment of a closed loop system 140 is shown in FIG. 4. The system 140 is an embodiment of a model used to generate the current Is that drives the resonant branch 102, FIG. 2, of the transducer. The system 140 includes an embodiment of implementing the closed loop transfer function G(s) of FIG. 3 to implement a notch filter. By implementing a notch filter, the desired mechanical output Y(f) of FIG. 1B is able to be achieved with a transducer that would otherwise generate the output Y(f) as shown in FIG. 1A. The current Is in the resonant branch 102 is not directly observable or otherwise measurable, therefore, it is indirectly measured by subtracting the current $I_{C0}$ in the capacitance C0 from the current $I_X$ entering the transducer. As described in greater detail below, the closed loop system 140 of FIG. 4 uses a feedback loop to control the current $I_S$ in the resonant branch 102.

The complete transducer transfer function of the transducer 132 is represented by the block Yx(s) and the reconstructed capacitance is represented by the block $Y_{C0}(s)$. In some embodiments, the block $Y_{CO}(s)$ represents the admittance of the capacitance C0. The resonant component 102 of the transducer is represented by a transfer function that is equal to $Yx(s)-Y_{C0}(s)$. Therefore, the current Is in the resonant branch 102 is calculated by subtracting the current $I_{CR}$ in the block $Y_{CO}(s)$ from the current $I_X$ that is representative of current flowing into the transducer. A device 144 represents a controller transfer function Gc(s) that is used to produce the flatband, band-pass as shown by the graph of FIG. 1B. By multiplying the transducer resonant transfer function $(Yx(s)-Y_{C0}(s))$ and the controller transfer function Gc(s) 144, the flatband, band-pass, closed loop transfer function G(s) is achieved, which yields the extended bandwidth BW of FIG. 1B. The in-band amplitude of the graph of FIG. 1B is given by the minimum of the transducer sensitivities or output magnitudes at the corner frequencies of the desired band-pass response.

The currents and voltages in the system 140 will be described followed by a description of the operation of the system 140. A current $I_{REF}$ is a reference current that is desired to flow into the resonant branch 102 of the transducer and flows into an adder 150. An error current $I_{ERR}$ is the error between the desired reference current $I_{REF}$ and the current $I_S$ flowing into the resonant branch 102. The current $I_{ERR}$ flows into the device 144 where it is transformed by the controller transfer function G(s). The device 144 outputs a current Ic that is input to both the transducer per the transfer function Yx(s) and the replicated capacitance $Y_{C0}(s)$. A current $I_X$ is the current flowing into the transducer, which includes the resonant branch 102 and the capacitance C0. The current $I_{CR}$ is the reconstruction of the portion of the current Ix that flows though the capacitance C0, which is shown by the transfer function $Y_{C0}(s)$. As stated above, the current $I_{CR}$ is calculated or approximated by modeling the capacitance C0 as described below. Based on the foregoing, the current $I_C$ is equal to the current Ix and the current $I_{CR}$. As described above, the current Is is the current flowing in the resonant branch 102 and is the current that is controlled in order to achieve the desired bandwidth from the transducer as shown in FIG. 1B.

The reconstruction or modeling of the current $I_{CR}$ in the capacitance C0 is performed by measuring the value of the capacitance C0 of the transducer or by calculating the current $I_{CR}$ flowing into a replica $C_R$ of the capacitance C0. The only measurement required to implement the closed loop system 140 is the measurement or calculation of the capacitance C0. The estimation of the other transducer parameters is not necessary to achieve a wider bandwidth.

Having described the components of the closed loop system 140, its operation will now be described. The value of the capacitance C0 is determined by measuring the capacitance of the transducer 132, FIG. 3. The value for $Y_{C0}(s)$ is then readily calculated along with the current $I_{CR}$ flowing through the capacitance C0. In the embodiment of FIG. 4, the value of $Y_{C0}(s)$ is the admittance of the capacitance C0. Based on the measurement of the capacitance C0, the value of the current $I_S$ is calculated as the difference between the input current Ix and the current $I_{CR}$. The system 140 uses an adder 152 to subtract the current $I_{CR}$ from the current Ix, which outputs the current Is. A signal representative of the current $I_S$ is fed back by a line 148 to the adder 150. The adder 150 subtracts the current $I_S$ from the reference current $I_{REF}$ to yield the error current $I_{ERR}$. When the current $I_S$ is too great, the error current $I_{ERR}$ becomes negative, so the device 144 reduces the voltage Vx. A reduction in the voltage Vx reduces the current Is. If the current $I_S$ is too small, the error current $I_{ERR}$ becomes positive and the device 144 increases the voltage Vx, which increases the current Is. Therefore, the current $I_S$ that achieves the flatband response of FIG. 1B is achieved.

It is noted above that the current Ix input to the block $Y_X(s)$ representative of the transducer 132 needs to be measured. In some embodiments, the voltage across a current sensing resistor is measured in order to determine the current Ix. However, such a sensing resistor introduces a transfer function with additional poles and zeros caused by the sensing resistor and other measurement devices that are connected or coupled to the sensing resistor. The sensing resistor and the devices connected or coupled thereto are referred to cumulatively as sensing circuitry. The combination of the transducer admittance and sensing circuitry is referred to as Go(s). The sensing resistor enables an accurate measurement of the current Ix as operating conditions of the motor 100, FIG. 1, change over time.

An example of using a series sensing resistor having a value of $R_{SNS}$ is provided below. In this example, the voltage across the sensing resistor is measured and converted to the digital domain using an analog-to-digital converter. The sensing resistor introduces a pole given by the resistance $R_{SNS}$ and the value of the capacitance C0, which is referred to below as C0. The frequency $\omega_p$ of the pole is given by equation (1) as follows:

$$\omega_p = \frac{1}{R_{SNS}C0} \qquad \text{Equation (1)}$$

In addition to the pole, the use of the digital domain typically requires an anti-aliasing filter that introduces an additional pole. These additional poles result in deviations between actual current $I_{C0}$ in the capacitance C0 and the modeled or replicated current $I_{CR}$, which are most prominent at high frequencies. The high frequency deviation causes instability which can be prevented by matching these poles in the replicated capacitor current measurement transfer function $Y_{C0}(s)$. The system 140 recovers stability by reconstructing the pole caused by the sensing resistor $R_{SNS}$ using an analogous replicated capacitor sense resistance $R_R$, and by reconstructing the anti-aliasing pole using an analogous low-pass filter. In such embodiments, the pole created by the sensing resistor $R_{SNS}$ is matched with a pole of the replicated capacitor sense resistor $R_R$. By matching the poles, the effects of the capacitance C0 are cancelled out, which makes controlling the current Is much easier.

In the following example, the measurement transfer function ($G_{C0}$) from the transducer input voltage Vx to the current sensing signal on the transducer and the transfer function ($G_{CR}$) from the input voltage Vx to the current sensing signal on the replica capacitor $C_R$ are shown as follows:

$$G_{C0} = \frac{R_{SNS}}{R_{SNS} + Z_{CO}} = \frac{sR_{SNS}C0}{1 + sR_{SNS}C0} \qquad \text{Equation (2)}$$

$$G_{CR} = \frac{R_R}{R_R + Z_{CR}} = \frac{sR_RC_R}{1 + sR_RC_R} \qquad \text{Equation (3)}$$

In order to achieve stability, the transfer functions as set forth in equation (4) need to be equalized as follows:

$$G_{CR}(s)=G_{C0}(s)\forall s \qquad \text{Equation (4)}$$

In order to achieve the stability of equation (4), the gain and the pole need to be equalized as shown in equation (5), wherein $\tau$ is the time constant.

$$R_RC_R=R_{SNS}C0=\tau \qquad \text{Equation (5)}$$

Based on equation (5), the current sensing transfer function is replicated in the capacitor transfer function. Therefore, the only item that needs to be estimated is the time constant $\tau$. In practice, this can be implemented by putting in an internal capacitance Cref (e.g. 0.1 pF) in the electronic system that drives the transducer. In some embodiments, the capacitance Cref may be specified in a datasheet of the transducer. A user of the transducer may then connect an arbitrary external sensing resistor Rs having a value $R_{SNS}$. The user may then match the current replica transfer function also replicating the sensing resistor $R_S$ and the anti-aliasing filter by means of the sensing resistor Rs and an additional resistor $R_R$ that is equal to or proportional to the value RsnsCO/Cref. By using the above described method, the measurement of the capacitance C0 is not required because the transducer capacitance information is available from indirect measurements or from the transducer specifications. Moreover, the embodiments described above enable the resistor $R_R$ to be external, so the user is able to connect an external anti-aliasing filter to the resistor $R_R$ that is equal to that of the sensing resistor $R_S$.

Figure 5:
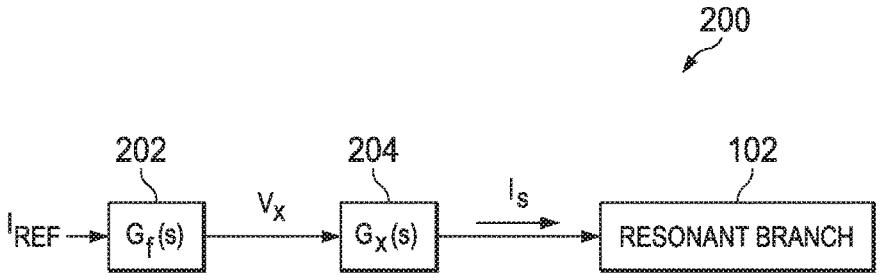
FIG. 5 is a block diagram of an open loop embodiment of a system for increasing the bandwidth of a transducer.

Having described the closed loop approach, the open loop approach will now be described. Reference is made to FIG. 5, which shows a block diagram of an open loop system 200. In summary, the open loop system 200 drives the transducer based on the open loop control of the acoustic pressure of the transducer 132, FIG. 3. In the system 200 of FIG. 5, $I_{REF}$ is the reference current that is desired to flow into the resonant branch 102 of the transducer 132. The block 202 is a device that performs a transfer function $G_F(s)$, which yields the desired bandwidth as shown in FIG. 1B. The voltage Vx is the driving voltage into the transducer. The box 204 contains a transfer function $G_X(s)$ that is the transfer function between the driving voltage Vx and the current Is that flows in the resonant branch 102 of the transducer 132.

The system 200 uses a parametric model of the transducer 132 to estimate the coefficients required to construct the transfer function $G_X(s)$ from the input voltage Vx to the current Is, which determines the acoustic pressure generated by the transducer 132. When the transfer function $G_X(s)$ is determined, the driving signal Iref of the transducer is passed through the transfer function $G_F(s)$. In some embodiments, the transfer function $G_F(s)$ is the inverse of the transfer function $G_X(s)$ in the bandwidth BW of FIG. 1B. One of the advantages of the open loop system 200 is that it does not have the stability issues of the closed-loop system 140 of FIG. 4.

Three examples of determining or estimating the coefficients of the transfer function Gx(s) are described below. In some embodiments, the estimations are performed when the transducer 132 is connected to a circuit and/or operating or before the transducer is connected to a circuit. In some embodiments, the input power is known and an acoustic wave sensor determines the magnitude of the acoustic wave. In some embodiments, the input voltage is measured or known. In some other embodiments, the acoustic wave sensor also measures the frequency of the acoustic wave.

The first method relates to estimating time-domain parameters. The method commences with identifying a realistic model of the transducer 132. The model can be represented by an equivalent circuit with linear and non-linear elements or by more complex circuits. The associated s-domain transfer function is characterized by N parameters. In some embodiments, the transfer function $G_F(s)$ is implemented in the time domain, so the s-domain model is transformed to the discrete time model in the z-domain. From the z-domain model, the expected autoregressive-moving-average (ARMA(p,q)) model in terms of the number of coefficients is recovered. In some embodiments, a moving average (MA(∞)) model is constructed and approximated to a $MA(q_a)$ model. The MA model can be replicated using a finite impulse response (FIR) filter, which is very stable. The finite numbers of the parameters of the chosen model are then approximated. The p and q parameters are designed according to the transducer model sophistication that is desired, and the computing power that is available in the electronic system to implement the ARMA model.

The second method implements a fast Fourier transform (FFT) of FIR filter parameters with a frequency span. In this method, the user provides an estimated center frequency. The center frequency may be estimated by the use of an external component, such as a resistor. In some embodiments, the estimated center frequency is provided by the use of digital signal processing. A vector of frequencies is created around the center frequency. The transducer 132 is stimulated with N sinusoidal waveforms with a sufficient number of periods for each frequency in order to enter the bandwidth of the transducer. The current input to the transducer is measured and the impedance is reconstructed based on the current measurement. There is just a single center frequency. The reason for stimulating the transducer with N sinusoidal waveforms at different wavelengths is to investigate the transducer response in the frequency domain and to characterize it in order to reconstruct the transducer impedance with the desired accuracy.

The third method involves estimating the FIR parameters using three points estimation. In this embodiment the parallel capacitance C0 in the transducer is estimated. The user provides an estimated center frequency. The center frequency may be selected as described above by use of external components or digital signal processing. A vector of two symmetrical frequencies around the center frequency is created. The frequencies are sufficiently far from each other in order to observe separately the inductive effect and capacitive effect. The transducer is stimulated with the sinusoidal waveforms of the two frequencies and with a sufficient number of periods for each frequency in order to reach the steady state behavior of the waveform envelope, having completed any transient behavior due to the transducer finite bandwidth. When the transducer is stimulated, the current in the transducer is measured for both frequencies. Based on the two current measurements, the impedance $Z_R$, FIG. 2, is calculated or estimated, which yields the center frequency of the transducer. A vector of arbitrary precision is created around the center frequency. The stimulation and measurement are repeated in order to characterize the Q of the transducer.

Figure 6:
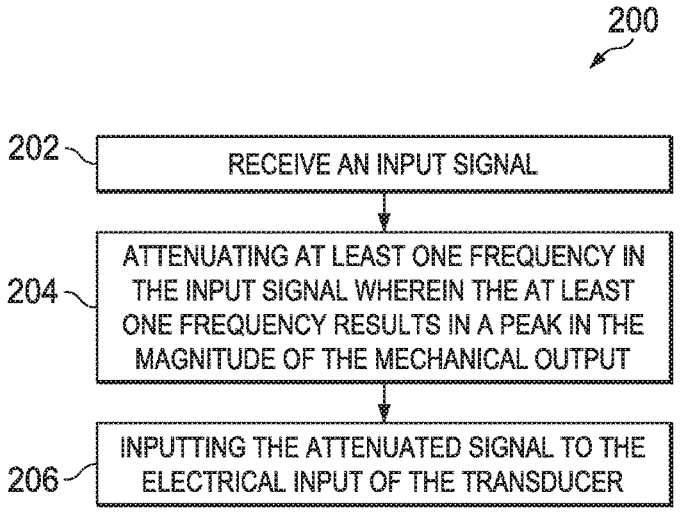
FIG. 6 is a flowchart of an operation of the system of FIG. 4.

The methods described above are shown in the flowchart of FIG. 6, which is a flowchart showing an example of increasing the bandwidth of a transducer. The flowchart starts at block 202 where an input signal is received. In the embodiment of FIG. 3, the input signal is the voltage from the power source 130. In block 204, at least one frequency in the input signal is attenuated, wherein the at least one frequency results in a peak in the magnitude of the mechanical output Y(f), FIG. 2. In block 206, the attenuated signal is input to the electrical input of the transducer.

While illustrative and presently preferred embodiments of integrated circuits have been described in detail herein, it is to be understood that the inventive concepts may be otherwise variously embodied and employed and that the appended claims are intended to be construed to include such variations except insofar as limited by the prior art.

What is claimed is:

1. A driver for a transducer, the transducer having an electrical input and producing a mechanical output, wherein the magnitude of the mechanical output of the transducer is dependent on the frequency and magnitude of current at the input, the driver comprising:

a device having a transfer function associated with the device, the device having a device input and a device output, the device output being connectable to the input of the transducer and the device input being connectable to a power source; wherein the device is for attenuating the current output at a frequency that causes a peak in the magnitude of the mechanical output of the transducer;

wherein the transducer has a capacitance branch in parallel with a resonant branch, and wherein a magnitude of a current through the resonant branch is controllable by the device to control the magnitude of the mechanical output, sensitivity of the transducer being adjusted to flatten a response curve of the transducer to increase bandwidth of its response, wherein the device is for attenuating through the resonant branch when the frequency of the current is between a first frequency and a second frequency and wherein the frequency of the current at the input that causes a peak in the magnitude of the mechanical output of the transducer is between the first frequency and the second frequency.

2. The driver of claim 1, wherein the magnitude of the mechanical output of the transducer is substantially even between the first frequency and the second frequency.

3. The driver of claim 1, wherein the magnitude of the mechanical output of the transducer between the first frequency and the second frequency varies by no more than 3 dB.

4. The driver of claim 1, wherein the transducer is an air-coupled transducer.

5. The driver of claim 1, wherein the mechanical output is an acoustic wave.

6. A driver for a transducer, the transducer having an electrical input and producing a mechanical output, wherein the magnitude of the mechanical output of the transducer is dependent on the frequency and magnitude of current passing through a resonant branch of the transducer, the driver comprising:

a control device having a control transfer function, the control device having a control input and a control output;

a transducer model for electrically modeling the transducer, the transducer model having a transducer model input that is coupled to the control output and a transducer model output;

a capacitance model for replicating a capacitance of the transducer, the capacitance model having a capacitance model input that is coupled to the control output and a capacitance model output, wherein the capacitance model is the admittance of a capacitance that is parallel to the resonant branch of the transducer; and a first adder for subtracting the capacitance model output from the transducer model output, the output of the first adder being proportional to the current that drives the transducer;

wherein the control device adjusts the control output to control the magnitude of the current through the resonant branch of the transducer, sensitivity of the transducer being adjusted to flatten a response curve of the transducer to increase bandwidth of its response, wherein the control device is for attenuating current between the control input and the control output in a predetermined bandwidth.

7. The driver of claim 6 further comprising a feedback path coupled between the first adder and the control input.

8. The driver of claim 7 further comprising a second adder having a first input that is coupled to the input signal, a second input that is coupled to the feedback path, and wherein the output of the second adder is coupled to the control input.

9. The driver of claim 6, wherein the control device is for attenuating current between the control input and the control output to cause the magnitude of the mechanical output of the transducer to be substantially flat over a predetermined bandwidth.

10. The driver of claim 6, wherein the transducer model is proportional to the admittance of the transducer.

11. The driver of claim 6, wherein the output of the first adder is for driving the mechanical output of the transducer to be substantially flat over a predetermined bandwidth.

12. The driver of claim 6, wherein the mechanical output of the transducer is an acoustic wave.

13. A method of a device driver for driving a transducer, the transducer having an electrical input and a mechanical output, the method comprising: receiving an input signal; determining a current in a resonant branch of the transducer based at least in part on a parallel capacitance of the transducer; attenuating the determined current in the resonant branch at least one frequency of a peak in the magnitude of the mechanical output; and inputting the attenuated signal to the electrical input of the transducer; adjusting sensitivity of the transducer to flatten a response curve thereof to increase bandwidth of its response, wherein the device driver is for attenuating through the resonant branch when the frequency of the current is between a first frequency and a second frequency and wherein the frequency of the current at the input that causes a peak in the magnitude of the mechanical output of the transducer is between the first frequency and the second frequency.

14. The method of claim 13 and further comprising cancelling effects of the parallel capacitance.

* * * * *